US009804541B2

(12) United States Patent
Yamashita et al.

(10) Patent No.: US 9,804,541 B2
(45) Date of Patent: Oct. 31, 2017

(54) HEATING DEVICE

(71) Applicant: SCREEN HOLDINGS CO., LTD., Kyoto (JP)

(72) Inventors: Shinsuke Yamashita, Kyoto (JP); Takeshi Katayama, Kyoto (JP)

(73) Assignee: SCREEN HOLDINGS CO., LTD., Kyoto (JP)

( * ) Notice: Subject to any disclaimer, the term of this patent is extended or adjusted under 35 U.S.C. 154(b) by 0 days.

(21) Appl. No.: 15/448,999

(22) Filed: Mar. 3, 2017

(65) Prior Publication Data

US 2017/0255136 A1 Sep. 7, 2017

(30) Foreign Application Priority Data

Mar. 4, 2016 (JP) ..... 2016-041770
Sep. 30, 2016 (JP) ..... 2016-193202

(51) Int. Cl.

| | |
|---|---|
| ***G03G 13/20*** | (2006.01) |
| ***G03G 15/20*** | (2006.01) |
| ***B41J 11/00*** | (2006.01) |
| ***F28F 9/26*** | (2006.01) |

(52) U.S. Cl.
CPC ..... *G03G 15/2017* (2013.01); *B41J 11/002* (2013.01); *F28F 9/26* (2013.01)

(58) Field of Classification Search
CPC .... B41J 2002/0052; B41J 35/18; B41J 35/16; B41J 11/002; G03G 15/2017; F28F 9/26
See application file for complete search history.

(56) References Cited

U.S. PATENT DOCUMENTS

2010/0265292 A1* 10/2010 Ohshima ..... B41J 2/1606 347/16
2014/0186078 A1* 7/2014 Imaizumi ..... G03G 15/2017 399/329
2015/0132035 A1* 5/2015 Nishizawa ..... H05B 6/365 399/329

FOREIGN PATENT DOCUMENTS

JP 2015-001706 A 1/2015

* cited by examiner

*Primary Examiner* — Kristal Feggins
(74) *Attorney, Agent, or Firm* — McDermott Will & Emery LLP

(57) ABSTRACT

A heating device includes a heating member having an opening formed at an end thereof along a direction of a rotary shaft, a heating element for heating the heating member from inside, a heating element support member having a heating element support portion at one end thereof for supporting an end of the heating element, and a tube opening at the other end, the tubular heating element support member being inserted into the heating member through the opening, and a coolant supplier for supplying a coolant from the tube opening for cooling the heating element support portion. The heating element support member includes coolant blowout holes formed between a portion thereof corresponding to a bearing supporting the rotary shaft and the heating element support portion for blowing the coolant out into the rotary shaft.

20 Claims, 7 Drawing Sheets

HEATING DEVICE

BACKGROUND OF THE INVENTION (1) Field of the Invention

This invention relates to a heating device including a heating member for contacting a medium to be heated, and a heating element mounted inside the heating member. This heating device is suited for fixing ink dispensed to printing paper in an inkjet printing apparatus, or fixing toner adhering to printing paper in an electrophotographic printing apparatus.

(2) Description of the Related Art

In recent years, plateless printing apparatus have been put to practical use, which do not require time to create plates, and yet are capable of high-speed printing while changing print contents as needed. Printing modes used in such plateless printing apparatus include an inkjet mode which forms print images by dispensing ink droplets directly to printing paper, and an electrophotographic mode which forms print images by transferring toner from an exposing drum to printing paper. Such a mode is employed as appropriate according to the purpose for which prints are used.

What is needed in a plateless printing apparatus, whether it employs the inkjet mode or the electrophotographic mode, is heating of the printing paper after printing is performed. Whether it is the inkjet mode or the electrophotographic mode, drying of ink droplets or fixation of toner by heating the printing paper after printing prevents scattering of the ink or toner to the internal structure of the plateless printing apparatus, or prevents damage to the printed image due to abrasion of the paper at the time of transportation.

The plateless printing apparatus which transports the printing paper at high speed employs a heating roller for heating such printing paper. The heating roller includes a heat source mounted inside such as a halogen lamp, sheathed heater, or electromagnetic inductor supported by a holding member for heating a roller body to heat printing paper transported so that the back surface of the paper having a print image formed thereon will contact the roller surface (see Japanese Unexamined Patent Publication No. 2015-1706, for example).

The heating roller used in the plateless printing apparatus is rotatable as driven by paper transportation, or by torque applied from a motor or the like. In order to realize smooth rotation, the heating roller has a rotary shaft thereof supported by bearings such as rolling bearings or plain bearings. Such bearings essentially require use of a lubricant in order to prevent damage to rolling elements such as balls or rollers or to the sliding plane.

In the case of an ordinary roller, the lubricant of the bearings can maintain its lubricating function for a relatively long period of time. However, in the case of the heating roller, the lubricant of the bearings will deteriorate in a relatively short period of time, since the heat from the roller heated by the heat source conducts to the rotary shaft to heat the rotary shaft to a high temperature.

Further, in order to prevent melting of an electrode at a heat source end supported by the holding member, the interior of the rotary shaft is ventilated to cool the heat source end. However, the hot air having been blown to the hot heat source end will heat the rotary shaft to cause a further temperature rise thereof when discharged as exhaust air from a gap between the holding member and the rotary shaft. As a result, the lubricant of the bearings deteriorates in a still shorter period of time.

Under such circumstances, the bearings of the heating roller have frequently been damaged since the lubricant can deteriorate at a very early stage. In order to prevent damage to the bearings, it is necessary frequently to supply the bearings with the lubricant, or to change the bearings per se. This has resulted in a frequent occurrence of situations necessitating a suspension of operation of the plateless printing apparatus.

SUMMARY OF THE INVENTION

In order to solve the above problem, the object of this invention is to provide a heating device having a construction for inhibiting an excessive temperature rise of a rotary shaft.

A heating device, according to this invention, comprises a heating member rotatable about a rotary shaft supported by a bearing, the heating member having an opening formed at an end thereof along a direction of the rotary shaft; a heating element disposed inside the heating member for heating the heating member; a tubular heating element support member having a heating element support portion at one end thereof for supporting an end of the heating element, and a tube opening at the other end, the tubular heating element support member being inserted into the heating member through the opening; and a coolant supplier for supplying a coolant from the tube opening for cooling the heating element support portion; wherein the heating element support member includes coolant blowout holes formed between a portion thereof corresponding to the bearing supporting the rotary shaft and the heating element support portion for blowing the coolant supplied from the coolant supplier out into the rotary shaft.

According to this invention, the tubular heating element support member has coolant blowout holes formed between the heating element support portion and the portion corresponding to the bearing which supports the rotary shaft of the heating member containing the heating element support member. When the coolant, which cools the heating element support portion supporting the end of the heating element, is supplied through the interior of the tubular heating element support member, the coolant blown out of the coolant blowout holes cools the rotary shaft, and at the same time mixes with exhaust air having cooled the heating element support portion, thereby to prevent overheating of the rotary shaft adjacent the bearing. Consequently, a lubricant of the bearing rotatably supporting the rotary shaft of the heating member does not deteriorate, which can prevent damage to the bearing.

In another aspect of this invention, a heating device comprises a heating member rotatable about a rotary shaft supported by a first bearing and a second bearing, the heating member having a first opening and a second opening formed at opposite ends thereof, respectively, along a direction of the rotary shaft; a heat generating member including a heating element, a first tubular heating element support member having a first heating element support portion at one end thereof for supporting one end of the heating element, and a first tube opening at the other end, a second tubular heating element support member having a second heating element support portion at one end thereof for supporting the other end of the heating element, and a second tube opening at the other end, the heat generating member being inserted into the heating member through the first opening and the second opening; and a coolant supplier for supplying a coolant from the first tube opening for cooling the first heating element support portion, and supplying the coolant from the second tube opening for cooling the second heating element support portion; wherein the heat generating member includes first coolant blowout holes formed between a portion thereof corresponding to the first bearing supporting the rotary shaft and the first heating element support portion for blowing the coolant supplied from the coolant supplier out into the rotary shaft, and second coolant blowout holes formed between a portion thereof corresponding to the second bearing supporting the rotary shaft and the second heating element support portion for blowing the coolant supplied from the coolant supplier out into the rotary shaft.

According to this invention, the heating member includes, mounted therein, a heat generating member having a first heating element support member and a second heating element support member. Each of the first heating element support member and second heating element support member has coolant blowout holes formed between the heat generating member and the portion corresponding to one of the bearings which support both the rotary shafts of the heating member. This construction prevents overheating of the rotary shafts adjacent both the bearings of the heating member. Consequently, a lubricant of each of the bearings rotatably supporting the rotary shafts of the heating member does not deteriorate, which can prevent damage to the bearings.

In this invention, it is preferred that the coolant supplier includes a first coolant supplier for cooling the first heating element support portion and a second coolant supplier for cooling the second heating element support portion.

With the coolant supplier for supplying the coolant to the first heating element support portion and second heating element support portion, the device further prevents overheating of the rotary shaft adjacent both the bearings of the heating member. Consequently, a lubricant of each of the bearings rotatably supporting the rotary shafts of the heating member does not deteriorate, which can prevent damage to the bearings.

In this invention, it is preferred that the coolant supplier comprises a fan for supplying air as the coolant.

Since the coolant supplied by the coolant supplier is air and the coolant supplier comprises a fan, this construction can prevent overheating of the rotary shaft adjacent the bearing supporting the heating member, without using a special coolant, the lubricant of the bearing does not deteriorate, which can prevent damage to the bearing.

In this invention, it is preferred that the coolant blowout holes comprise a plurality of perforations formed in the heating element support member.

With the coolant blowout holes comprising a plurality of perforations formed in the heating element support member, the coolant blown out of the coolant blowout holes cools the rotary shaft and mixes with the exhaust air, thereby to prevent overheating of the rotary shaft adjacent the bearing. Consequently, the lubricant of the bearing rotatably supporting the rotary shaft of the heating member does not deteriorate, which can prevent damage to the bearing.

In this invention, it is preferred that the heating device is for use in a drying mechanism for drying ink dispensed to printing paper in an inkjet printing apparatus.

The heating device can be used for drying the ink in the inkjet printing apparatus.

In this invention, it is preferred that the heating device is for use in a fixing mechanism for fixing toner adhering to printing paper in an electrophotographic apparatus.

The heating device can be used for fixing the toner in the electrophotographic apparatus.

BRIEF DESCRIPTION OF THE DRAWINGS

For the purpose of illustrating the invention, there are shown in the drawings several forms which are presently preferred, it being understood, however, that the invention is not limited to the precise arrangement and instrumentalities shown.

DESCRIPTION OF THE PREFERRED EMBODIMENTS

Preferred embodiments of this invention will be described in detail hereinafter with reference to the drawings.

First Embodiment

Figure 1:
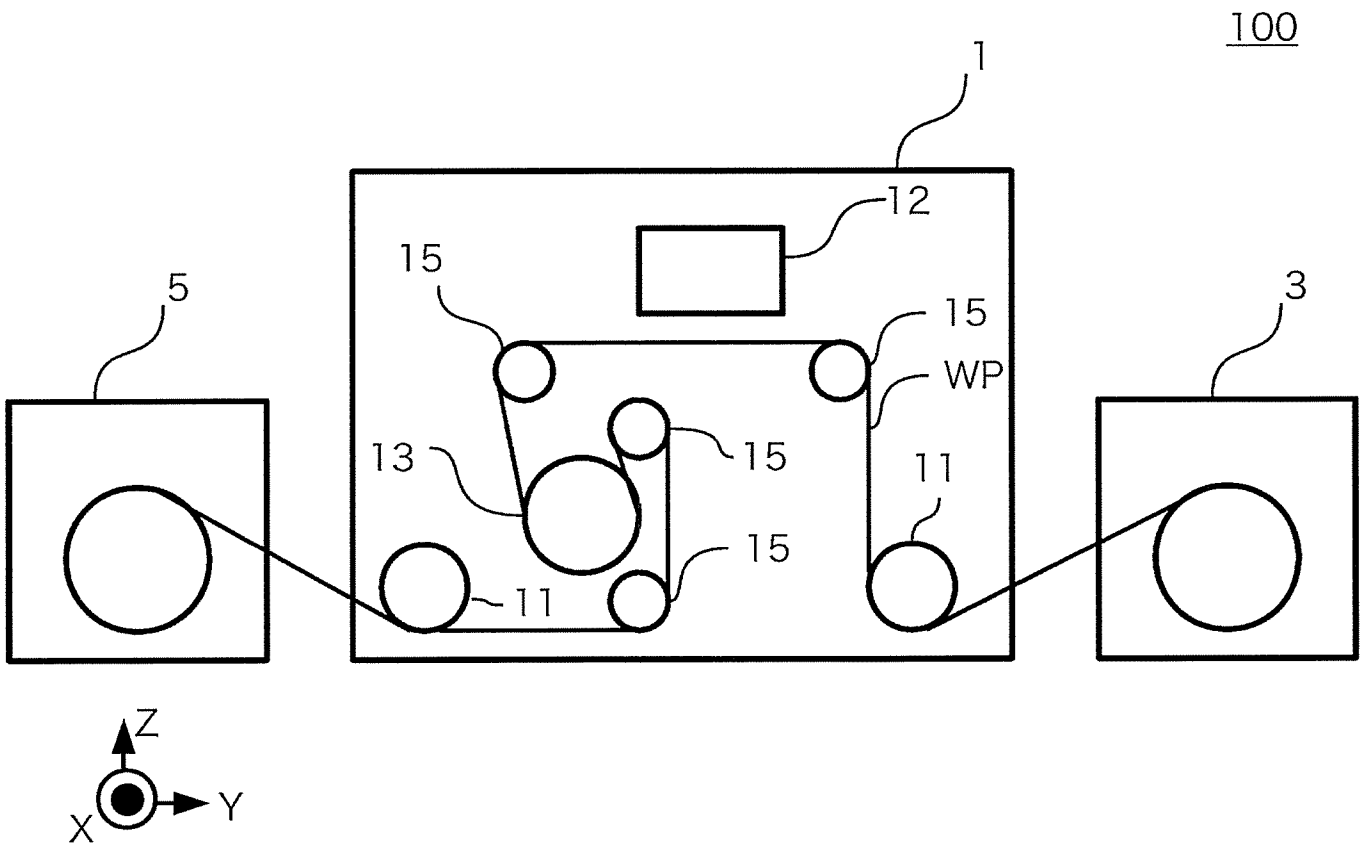
FIG. 1 is a schematic view of an inkjet printing apparatus 100 in a first embodiment of this invention.

FIG. 1 is a view illustrating a construction of an inkjet printing apparatus 100 according to this invention.

The inkjet printing apparatus 100 includes a paper feeder 3, a printing station 1, and a takeup roller 5. The direction of Y-axis in the figure indicates a horizontal direction in which the inkjet printing apparatus 100 is installed on a floor. The direction of X-axis indicates a direction in which the inkjet printing apparatus 100 has a depth.

The paper feeder 3 holds web paper WP in a roll form to be rotatable about a horizontal axis, and unwinds the web paper WP to feed it to the printing station 1. The printing station 1 prints images on the surface of the web paper WP. The takeup roller 5 winds up about a horizontal axis the web paper WP printed in the printing station 1. Regarding the supply side of the web paper WP as upstream and the discharge side of the web paper WP as downstream, the paper feeder 3 is disposed upstream of the printing station 1, and the takeup roller 5 downstream of the printing station 1.

The printing station 1 has a plurality of drive rollers 11, a print head 12, a drying unit 13, and a plurality of transport rollers 15.

The drive rollers 11 are rollers that provide drive for transporting the web paper WP taken in from the paper feeder 3 to the takeup roller 5. The web paper WP taken in by one drive roller 11 is smoothly transported by the transport rollers 15. The drive rollers 11 are arranged rearward of the print head 12 as well as rearward of the paper feeder 3, and also have a function to apply tension for performing appropriate recording on the web paper WP. The transport rollers 15 have a function to support the web paper WP under tension in a recording position, and also a function to inhibit meandering and skewing of the web paper WP.

The print head 12 forms images by dispensing ink supplied from an ink tank, not shown, as ink droplets to the web paper WP. The print head 12 has a length larger than a width of the transported web paper WP in a transverse direction thereof (direction perpendicular to the transport direction), and is installed to maintain a predetermined spacing from the web paper WP.

Although only one print head 12 is shown here, when performing color printing, four print heads 12 are provided to dispense color inks of CMYK. In order to enhance color representation, five or more print heads 12 may be provided.

The drying unit 13 is a heating roller, which has a halogen lamp as a heating device built in the roller around which the web paper WP is wound, in order to dry the ink which the print head 12 has dispensed to the web paper WP.

The above drying unit 13 corresponds to the "heating device" and "drying mechanism" in this invention.

The components of the inkjet printing apparatus 100 are operable under overall control of a controller, not shown, to perform printing on the web paper WP.

Figure 2:
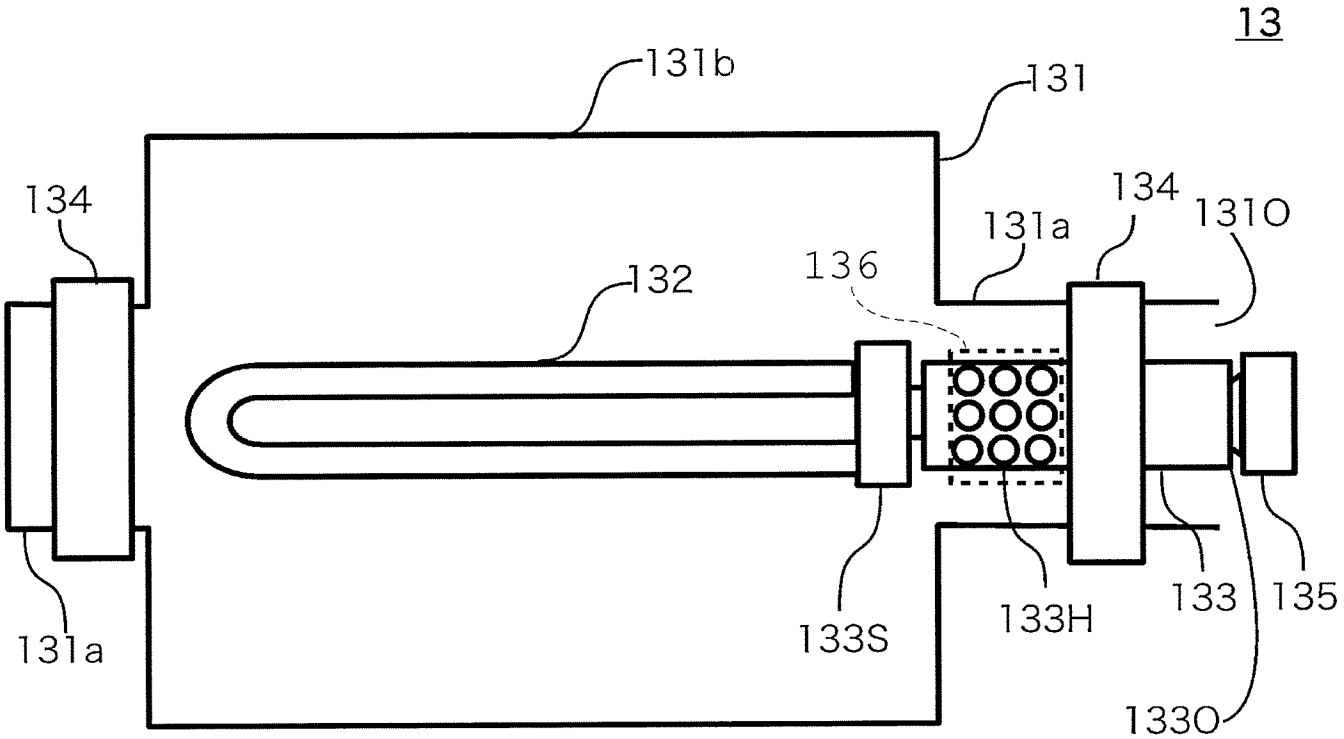
FIG. 2 is a view illustrating a drying unit 13 in the first embodiment of this invention.

FIG. 2 is a view illustrating the drying unit 13. FIG. 2 shows the construction of the drying unit 13 disposed inside the printing station 1, with the direction of its depth corresponding to the direction of Y-axis.

The drying unit 13 includes a rotary cylinder 131, a halogen lamp 132, a halogen lamp holding member 133, bearings 134, a cooling fan 135, and a rotary cylinder drive motor 136.

The rotary cylinder 131 is a tubular member formed of steel or aluminum, for example, and having suitable thermal conductivity and strength. The rotary cylinder 131 consists of a contact surface portion 131*b* for contacting the web paper WP wound thereon, and a rotary shaft 131*a* for rotating the contact surface portion 131*b*.

The rotary shaft 131*a* has sites supported by the bearings 134 described hereinafter, for enabling rotation of the rotary cylinder 131. Consequently, the web paper WP is transported smoothly during a drying operation, without giving any unnecessary resistance to the transportation of the web paper WP.

The rotary shaft 131*a* is open, and the halogen lamp 132 held by the halogen lamp holding member 133 is inserted from the opening portion (opening 131O). The opening 131O of the rotary shaft 131*a* serves as a discharge path of exhaust air having cooled an electrode of the halogen lamp 132 (details being described hereinafter).

The contact surface portion 131*b* is a cylindrical member having a width in the direction of X-axis equal to or larger than the width of the web paper WP, and is heated by the halogen lamp 132 provided inside. By conducting the heat to the web paper WP wound around into contact therewith, the contact surface portion 131*b* dries the web paper WP having the ink dispensed by the print head 12.

FIG. 2 shows that there is a difference in diameter between the rotary shaft 131*a* and the contact surface portion 131*b* of the rotary cylinder 131. However, the diameters of the rotary shaft 131*a* and the contact surface portion 131*b* may be in agreement. Further, while it is desirable that the rotary shaft 131*a* and contact surface portion 131*b* are formed integral, the contact surface portion 131*b* and rotary shaft 131*a* may be separate from each other and joined together to constitute the rotary cylinder 131.

The above rotary cylinder 131 corresponds to the "heating member" in this invention.

The halogen lamp 132 is a heat source for heating the contact surface portion 131*b*. The halogen lamp 132 has an end thereof supported by the halogen lamp holding member 133 described hereinafter, and preferably is provided in a set of two or more lengths inside the rotary cylinder 131 to irradiate the interior of the contact surface portion 131*b*. The heat radiating from the halogen lamp 132 to the interior of the contact surface portion 131*b* is conducted from the interior of the contact surface portion 131*b* to the outer surface of the contact surface portion 131*b* and further to the web paper WP in contact with the outer surface, thereby to dry the web paper WP.

The above halogen lamp 132 corresponds to the "heating element" in this invention.

The halogen lamp holding member 133 is a tubular member for holding the halogen lamp 132 inside the rotary cylinder 131. The halogen lamp holding member 133 is formed of steel or stainless steel to have appropriate strength to hold the halogen lamp 132.

The halogen lamp holding member 133 has a socket 133S at one end thereof for holding the end of the U-shaped halogen lamp 132, the other end with a tube opening 133O being supported by a housing, not shown, of the printing station 1. From the tube opening 133O of the halogen lamp holding member 133 a power cord, not shown, is connected to the socket 133S to supply electric power to the electrode of the halogen lamp 132. Since passage of cooling air is necessary, the halogen lamp holding member 133 has the socket 133S with a gap in between.

The halogen lamp holder member 133 holds the halogen lamp 132 with an appropriate clearance from the rotary shaft 131*a*. The halogen lamp holding member 133 has a diameter 10 mm less than the diameter of the rotary shaft 131*a*, for example. This allows the rotary cylinder 131 to rotate free of obstruction, and allows the exhaust air after cooling the socket 133S to pass through the gap between the rotary shaft 131*a* and halogen lamp holding member 133 as described hereinafter.

The halogen lamp holding member 133 further includes cooling air blowout holes 133H. The cooling air blowout holes 133H, while directly cooling the rotary shaft 131*a*, blow out part of the air passing through the halogen lamp holding member 133 in order to lower the temperature of the exhaust air having cooled the socket 133S holding the end of the halogen lamp 132 (details described hereinafter).

The above halogen lamp holding member 133 corresponds to the "heating element support member" in this invention.

The bearings 134 are provided for rotatably supporting the rotary shaft 131*a*. The bearings 134 are supported by the housing, not shown, of the printing station 1 to hold the rotary shaft 131*a* rotatably. The illustrated bearings 134 are ball bearings, each including a member penetrated by the rotary shaft 131*a* and a main body of the bearing 134, which slidingly fit each other through a plurality of balls not shown. A lubricant is applied to each of these balls.

The bearings 134 correspond to the "bearings" in this invention.

The cooling fan 135 is a fan for blowing into the halogen lamp holding member 133 the air for cooling the socket 133S holding the end of the halogen lamp 132. The cooling fan 135 is located in a position adjoining the tube opening 133O of the halogen lamp holding member 133 to blow the air into the halogen lamp holding member 133. The air blown from the cooling fan 135 into the halogen lamp holding member 133 cools the socket 133S and the end of the halogen lamp 132.

The cooling fan 135 has a preferred flow rate of about 2 $m^3$/min in order to cool the socket 133S, and also to lower the temperature of exhaust air discharged from the gap between the rotary shaft 131*a* and halogen lamp holding member 133 as described hereinafter, In order to blow the air appropriately from the tube opening 133O of the halogen lamp holding member 133, it is desirable for the cooling fan 135 to have a guide for narrowing down the air streams. Further, it is desirable that the guide has a recess for allowing passage of the above-mentioned power cord not shown.

Here, the cooling fan 135 is disposed at one end which is the tube opening 133O of the halogen lamp holding member 133. The position of the cooling fan 135 can be changed according to the position of the tube opening 133O at the end of the halogen lamp holding member 133.

The above cooling fan 135 corresponds to the "coolant supplier" and "fan" in this invention.

The rotary cylinder drive motor 136 rotates the rotary cylinder 131 in order to assist transportation of the web paper WP. When the transportation velocity of the web paper WP is slow, even if the web paper WP contacts the rotary cylinder 131 for drying, major variations do not occur to the web paper WP transported. However, when the transportation velocity of the web paper WP is fast, the contact with the rotary cylinder 131 will result in a hunching due to a velocity difference between the transportation velocity of the web paper WP and the rotary cylinder 131, and thus a defective printing in the inkjet printing apparatus 100.

So, the rotary cylinder drive motor 136 gives a predetermined rotation to the rotary cylinder 131 to decrease the velocity difference between the transportation velocity of the web paper WP and the rotary cylinder 131, thereby to prevent the hunching of the web paper WP. The rotating velocity of the rotary cylinder 131 by the rotary cylinder drive motor 136 is controlled by the controller, not shown, of the printing station 1. The rotary cylinder drive motor 136 may be used as a drive roller 11 contributing to the transportation of the web paper WP.

Figure 3B:
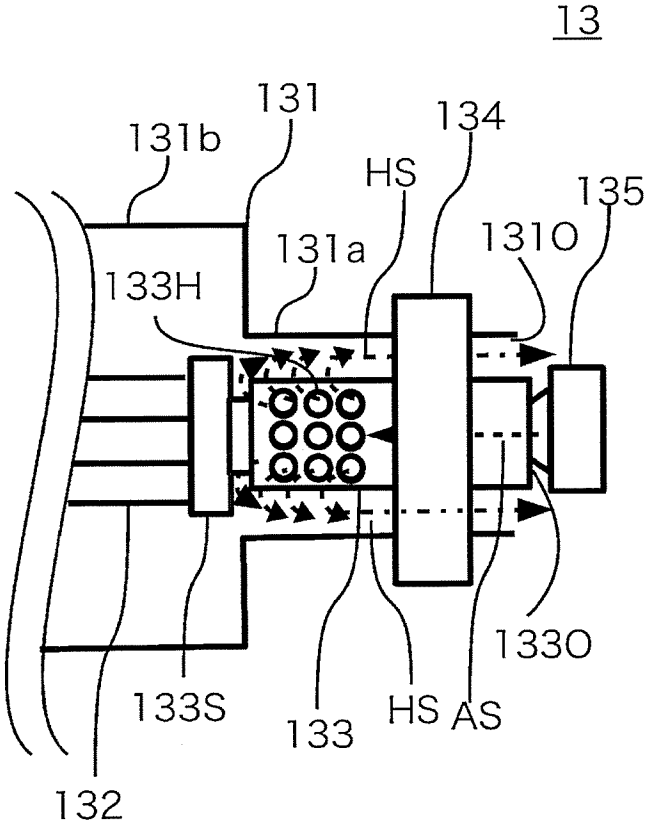
FIGS. 3A and 3B are views illustrating cooling of a socket 133S which supports an end of a halogen lamp 132.
Figure 3A:
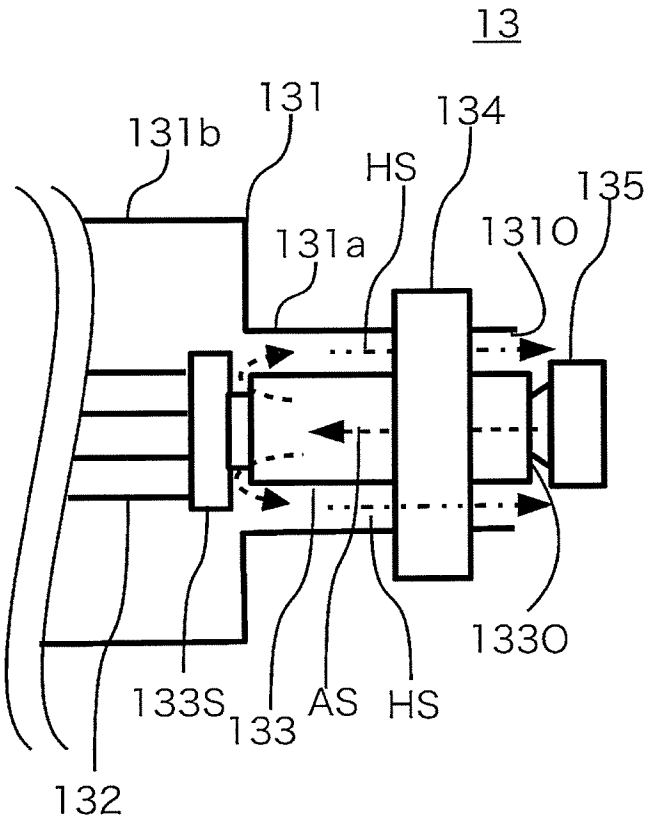
Fig.3A (PRIOR ART)

FIGS. 3A and 3B are views illustrating cooling of the socket 133S which supports the end of the halogen lamp 132. In particular, FIG. 3A is a view illustrating a conventional construction and its problem, while FIG. 3B is a view illustrating the construction and function of the first embodiment.

In the case of FIG. 3A, air streams AS (represented in broken lines) produced by the cooling fan 135 are blown from the tube opening 133O of the halogen lamp holding member 133 against the socket 133S supporting the halogen lamp 132 to cool the socket 133S.

The air streams AS having cooled the end of the socket 133S turn into exhaust streams HS (represented in two-dot chain lines), blow out of the gap between the halogen lamp holding member 133 and socket 133S, and flow through the gap between the halogen lamp holding member 133 and rotary shaft 131*a* to be discharged from the opening 131O of the rotary cylinder 131 outside the rotary cylinder 131.

Since, at this time, the exhaust streams HS have taken the heat off the socket 133S and are discharged along with the air heated inside the rotary cylinder 131, the rotary shaft 131*a* in contact with the contact surface portion 131*b* heated by the halogen lamp 132 is further heated by the heat radiating from the exhaust streams HS besides the heat conducted from the contact surface portion 131*b*.

In order to dry the ink droplets dispensed to the web paper WP, the internal temperature of the contact surface portion 131*b* has risen to about 180° C.-200° C. The surface temperature of the rotary shaft 131*a* therefore also rises to about 180° C. due to the heat radiation from the exhaust streams HS discharged after cooling the socket 133S in addition to the heat conduction from the contact surface portion 131*b*, although the rotary shaft 131*a* is spaced apart from the halogen lamp 132.

The lubricant used for the bearing 134 which rotatably support the rotary shaft 131*a* deteriorates to lose its function under the influence of such high temperature of the rotary shaft 131*a*. This can result in damage to the bearing 134.

The halogen lamp holding member 133 shown in FIG. 3B is different from the halogen lamp holding member 133 shown in FIG. 3A in including the cooling air blowout holes 133H. As seen, the halogen lamp holding member 133 has the cooling air blowout holes 133H formed therein between the socket 133S and a portion of the holding member 133 corresponding to the rotary shaft 131*a* where it is supported by the bearing 134. Part of the air streams AS are blown out through the holes 133H into the rotary shaft 131*a*.

The diameter of the cooling air blowout holes 133H is determined from maintenance of the strength of the halogen lamp holding member 133 and cooling of the socket 133S by the air streams AS. Where the diameter of the halogen lamp holding member 133 is about 60 mm, it is desirable that each of the cooling air blowout holes 133H has a diameter of about 10 mm, and that the cooling air blowout holes 133H include about ten holes 133H provided in the circumferential direction of the halogen lamp holding member 133, and about three columns of holes arranged at intervals of about 30 mm.

The air streams AS produced by the cooling fan 135 flow through the tube opening 133O of the halogen lamp holding member 133 to cool the socket 133S, and pass as exhaust streams HS through the gap between the halogen lamp holding member 133 and rotary shaft 131*a* to be discharged outside from the opening 131O of the rotary cylinder 131. The above movement in FIG. 3B is the same as in FIG. 3A. However, with the cooling air blowout holes 133H formed in the halogen lamp holding member 133, part of the air streams AS for cooling the socket 133S blow out of the halogen lamp holding member 133 into the rotary shaft 131*a*. The temperature of the rotary shaft 131*a* lowers through a heat exchange taking place between the air streams AS and rotary shaft 131*a*. Part of the air streams AS lower the temperature of the exhaust streams HS by mixing with the exhaust streams HS having cooled the socket 133S.

As opposed to the temperature of the rotary shaft 131*a* shown in FIG. 3A being about 180° C., the temperature of the rotary shaft 131*a* in FIG. 3B where the cooling air blowout holes 133H are provided lowers to about 150° C. Thus, as a result of inhibiting a temperature rise of the rotary shaft 131*a* to eliminate overheating, a temperature rise of the bearing 134 is prevented to extend the life of the lubricant used for the bearing 134, thereby to prevent damage to the bearing 134.

The position of the halogen lamp holding member 133 where the cooling air blowout holes 133H are formed is selected to be between the portion corresponding to the bearing 134 rotatably supporting the rotary shaft 131*a* and the socket 133S with a view to preventing a temperature rise of the rotary shaft 131*a* adjacent the bearing 134. This is because the air streams AS, even if part thereof blow out from between the cooling fan 135 and bearing 134, cannot contribute to cooling of the rotary shaft 131*a* which influences the bearing 134, or to prevention of overheating of the rotary shaft 131*a* by temperature lowering of the exhaust streams HS.

The above air streams AS correspond to the "coolant" in this invention. The above cooling air blowout holes 133H correspond to the "coolant blowout holes" and the "plurality of perforations" in this invention.

Figure 4B:
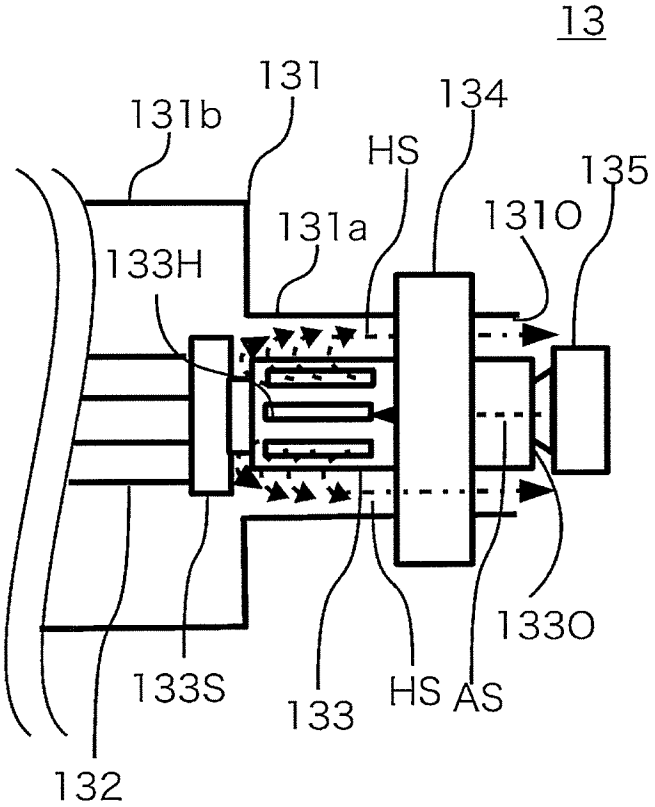
FIGS. 4A and 4B are views illustrating other forms of cooling air blowout holes 133H.
Figure 4A:
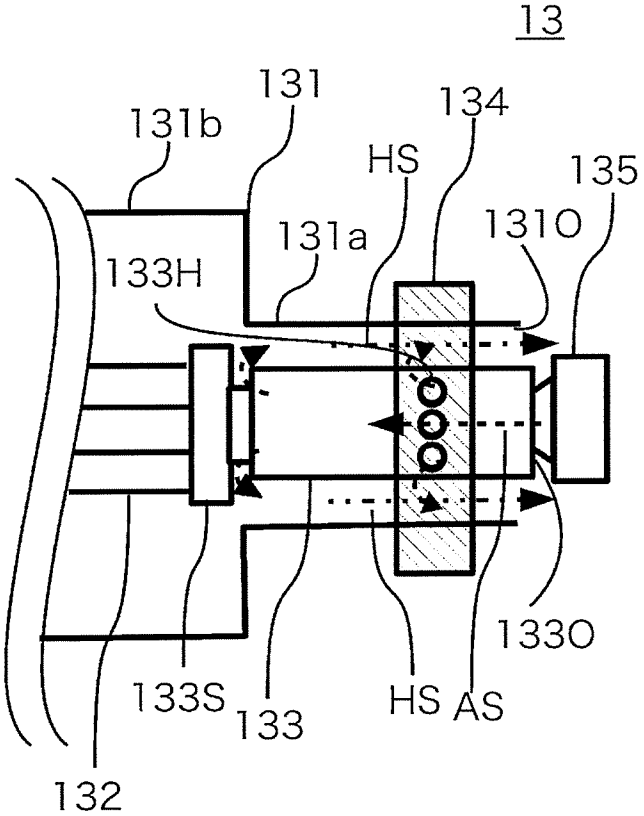

Note that the cooling air blowout holes 133H are not limited to the form shown in FIGS. 2 to 3B. FIGS. 4A and 4B are views illustrating other possible forms of the cooling air blowout holes 133H.

FIG. 4A shows a state where the cooling air blowout holes 133H are formed only in a portion corresponding to the rotary shaft 131*a* where it is supported by the bearing 134 (represented in hatches). In this case, as far as lowering of the temperature of the exhaust streams HS is concerned, the illustrated arrangement is inferior to the cooling air blowout holes 133H shown in FIGS. 2 to 3B. However, since the air streams AS are blown out to the portion of the rotary shaft 131*a* supported by the bearing 134, this arrangement has a better effect of directly cooling the supported portion of the rotary shaft 131*a*. Further, since the air streams AS reach the target in an increased quantity, the illustrated arrangement has a better effect of cooling the socket 133S than the halogen lamp holding member 133 shown in FIGS. 2 to 3B.

FIG. 4B shows a state where the cooling air blowout holes 133H are in form of a plurality of slits instead of the plurality of holes. The slits are about 10 mm wide and about 40 mm long. The cooling air blowout holes 133H can be provided by forming 10 such slits in the circumferential direction of the halogen lamp holding member 133.

Since the temperature of the rotary shaft 131*a* and the temperature of exhaust streams HS are reduced in this case by blowing out the air streams AS, overheating of the rotary shaft 131*a* can be inhibited to prevent damage to the bearing 134.

Thus, the inkjet printing apparatus 100 having the drying unit 13 shown in FIG. 2 can improve printing efficiency by reducing the time for maintenance of the drying unit 13.

Second Embodiment

The drying unit 13 shown in FIG. 2 has been described with reference to a form in which the halogen lamp holding member 133 holds the U-shaped halogen lamp 132 in a cantilever fashion, and only one side of the halogen lamp holding member 133 is cooled. Where the halogen lamp 132 has electrodes at opposite ends thereof, the halogen lamp holding member 133 needs a construction for holding the halogen lamp 132 at the opposite ends.

Figure 5:
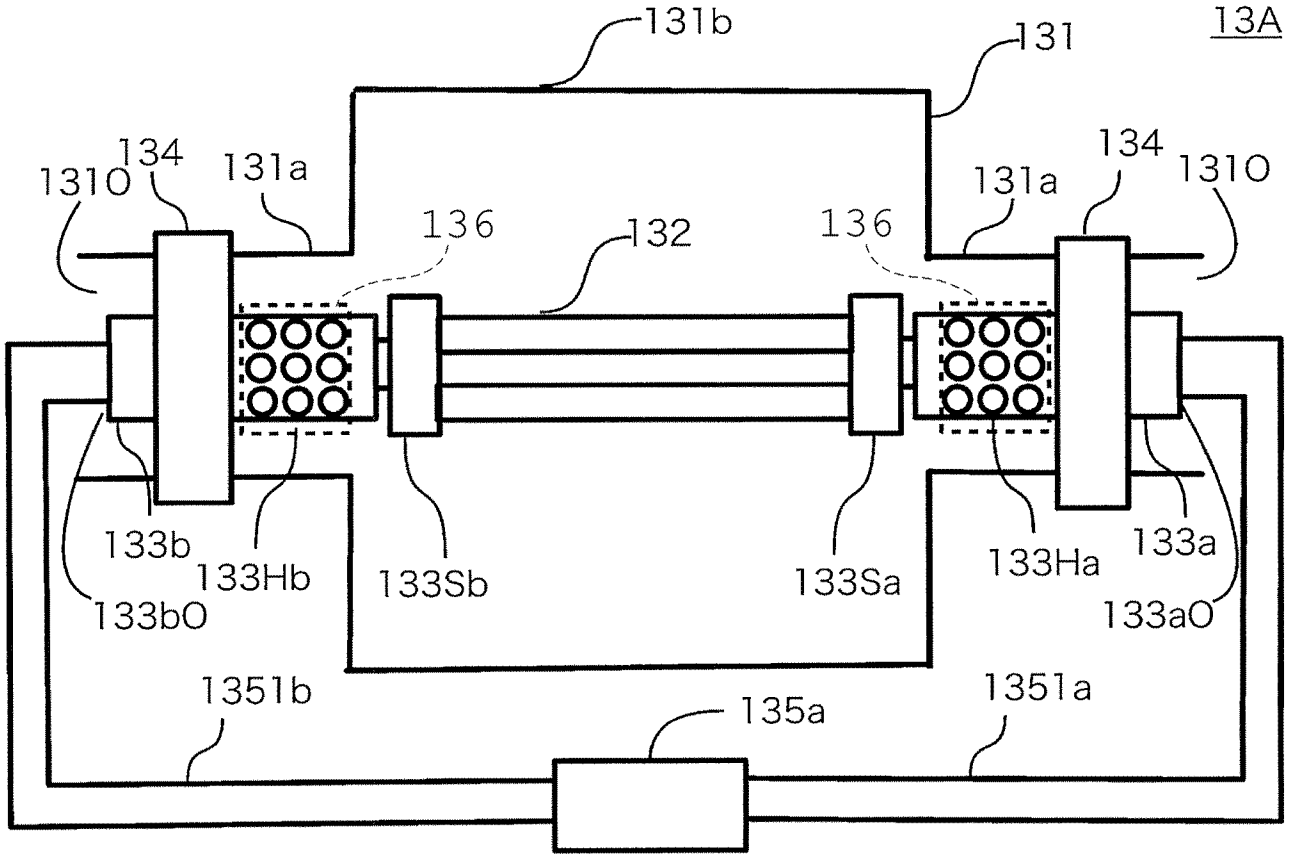
FIG. 5 is a view illustrating a construction of a drying unit 132 with a halogen lamp 132 having electrodes at opposite ends thereof in a second embodiment of this invention.

FIG. 5 is a view illustrating a construction of a drying unit 13A with the halogen lamp 132 having electrodes at the opposite ends thereof. As in FIG. 2, the drying unit 13A has a rotary cylinder 131, bearings 134, and a rotary cylinder drive motor 136. Since the halogen lamp 132 has electrodes at the opposite ends thereof, the features different from what is shown in FIG. 2 lie in that halogen lamp holding members 133*a* and 133*b* are provided which include cooling air blowout holes 133Ha and 133Hb, respectively, and that a cooling fan 135*a* leads air streams AS to tube openings 133*a*O and 133*b*O of the halogen lamp holding members 133*a* and 133*b* by means of ducts 1351*a* and 1351*b*.

The halogen lamp holding members 133*a* and 133*b* supported by the housing, not shown, of the printing station 1 have sockets 133Sa and 133Sb at ends thereof, respectively, which hold the opposite ends of the halogen lamp 132. Power cables, not shown, are passed through the interiors of the halogen lamp holding members 133*a* and 133*b* to supply electric power to the electrodes of the halogen lamp 132.

The halogen lamp holding member 133*a*, halogen lamp 132, and halogen lamp holding member 133*b* correspond to the "heat generating member" in this invention.

The ducts 1351*a* and 1351*b* are connected to the tube openings 133*a*O and 133*b*O at the sides of the halogen lamp holding members 133*a* and 133*b* supported by the housing, not shown, of the printing station 1, and air streams AS from the cooling fan 135*a* described hereinafter are supplied to the tube openings 133*a*O and 133*b*O.

The cooling fan 135*a* supplies the air streams AS through the ducts 1351*a* and 1351*b* for cooling the sockets 133Sa and 133Sb of the halogen lamp holding members 133*a* and 133*b* holding the opposite ends of the halogen lamp 132. Since the cooling fan 135*a* needs to cool the sockets 133Sa and 133Sb, it is desirable to use a fan of higher performance than the cooling fan 135, and specifically a fan having a flow rate of 4 $m^3$/min or higher.

The air streams AS supplied from the cooling fan 135*a* flow through the tube openings 133*a*O and 133*b*O of the halogen lamp holding members 133*a* and 133*b*, and cool the sockets 133Sa and 133Sb, respectively. At this time, part of the air streams AS blow out of the cooling air blowout holes 133Ha and 133Hb, thereby to lower the temperature of the rotary shaft 131*a*, and lower the temperature of exhaust streams HS discharged from gaps between the halogen lamp holding members 133*a* and 133*b* and the rotary shaft 131*a* containing the halogen lamp holding members 133*a* and 133*b*. This can prevent a temperature rise of the bearings 134 rotatably supporting the rotary shaft 131*a*.

The inkjet printing apparatus 100 having the drying unit 13A shown in FIG. 5 can improve printing efficiency by reducing the time for maintenance of the drying unit 13A similarly to the construction shown in FIG. 2. In particular, although the halogen lamp 132 has electrodes at the opposite ends thereof, the cooling air blowout holes 133Ha and 133Hb formed in the halogen lamp holding members 133*a* and 133*b* serve to inhibit a temperature rise of the rotary shaft 131*a* thereby to prevent overheating thereof, and can prevent damage to the bearings 134.

Third Embodiment

Figure 6:
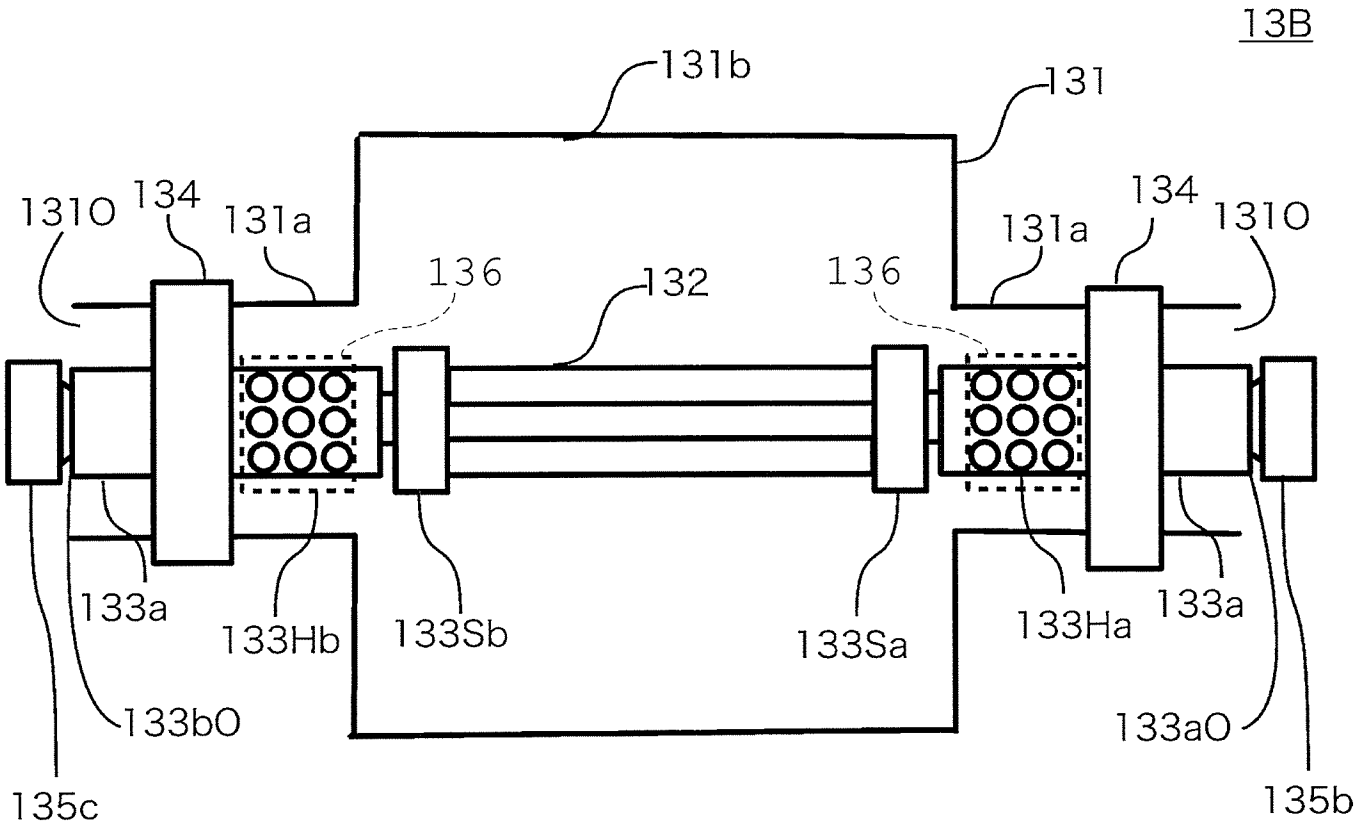
FIG. 6 is a view illustrating a construction of a drying unit 132 with a halogen lamp 132 having electrodes at opposite ends thereof in a third embodiment of this invention.

FIG. 6 is a view illustrating a construction of a drying unit 13B with the halogen lamp 132 having electrodes at the opposite ends thereof. As in FIG. 5, the drying unit 13B has a rotary cylinder 131, halogen lamp holding members 133*a* and 133*b* including cooling air blowout holes 133Ha and 133Hb since the halogen lamp 132 has electrodes at the opposite ends thereof, bearings 134, and a rotary cylinder drive motor 136. The feature different from the drying unit 13A shown in FIG. 5 lies in that cooling fans 135*b* and 135*c* are provided for the tube openings 133*a*O and 133*b*O adjacent the sides of the halogen lamp holding members 133*a* and 133*b* supported by the housing, not shown, of the printing station 1.

The cooling fans 135*b* and 135*c* cool the sockets 133Sa and 133Sb by sending air streams AS from the tube openings 133*a*O and 133*b*O of the halogen lamp holding members 133*a* and 133*b*, respectively. Part of the air streams AS blow out of the cooling air blowout holes 133Ha and 133Hb, thereby to lower the temperature of the rotary shaft 131*a*, and lower the temperature of exhaust streams HS discharged from gaps between the halogen lamp holding members 133*a* and 133*b* and the rotary shaft 131*a* containing the halogen lamp holding members 133*a* and 133*b*. This can prevent a temperature rise of the bearings 134 rotatably supporting the rotary shaft 131*a*.

Since the cooling fans 135*b* and 135*c* blow the air streams AS into the halogen lamp holding members 133*a* and 133*b*, respectively, their power may be similar to that of the cooling fan 135 shown in FIG. 2, i.e. about 2 $m^3$/min.

The inkjet printing apparatus 100 having the drying unit 13B shown in FIG. 6 can improve printing efficiency by reducing the time for maintenance of the drying unit 13B similarly to the construction shown in FIG. 2. In particular, although the halogen lamp 132 has electrodes at the opposite ends thereof, the cooling air blowout holes 133Ha and 133Hb formed in the halogen lamp holding members 133*a* and 133*b* serve to inhibit a temperature rise of the rotary shaft 131*a* thereby to prevent overheating thereof, and can prevent damage to the bearings 134.

Fourth Embodiment

Figure 7:
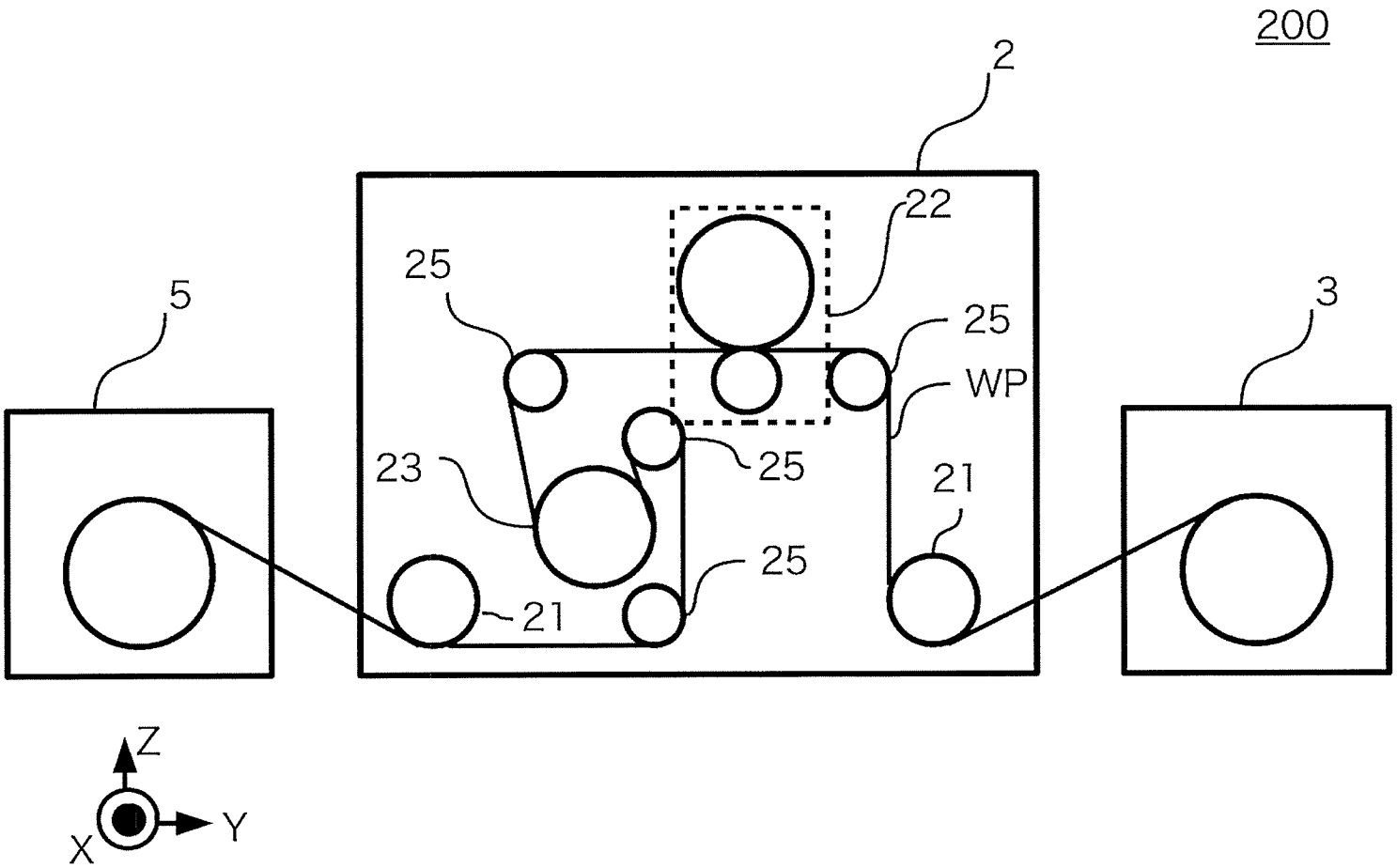
FIG. 7 is a schematic view of an electrophotographic printing apparatus 200 in a fourth embodiment of this invention.

FIG. 7 is a view illustrating an electrophotographic printing apparatus 200 according to this invention. The electrophotographic printing apparatus 200 includes a paper feeder 3, a printing station 2, and a takeup roller 5.

The paper feeder 3 and takeup roller 5 are the same as those in the inkjet printing apparatus 100, and their description is omitted here. The printing station 2 performs printing on the surface of web paper WP in the electrophotographic mode.

The printing station 2 has a plurality of drive rollers 21, an electrophotographic unit 22, a fixing unit 23, and a plurality of transport rollers 25. The drive rollers 11 and transport rollers 15 are the same as the drive rollers 21 and transport rollers 25 of the printing station 1, and their description is omitted here.

The electrophotographic unit 22 forms print images by transferring toner from an exposing drum to the web paper WP. The toner used in the electrophotographic unit 22 may be powder toner, or may be liquid toner.

Although this figure depicts only one electrophotographic unit 22, when effecting color printing, four electrophotographic units 22 are provided to transfer toners corresponding to CMYK colors. Or five or more electrophotographic units 22 may be provided when use of more toners is desired.

The toner transferred to the web paper WP in the electrophotographic unit 22 is not yet fixed on the paper. The fixing unit 23 includes a heating roller for melting and fixing the toner on the surface of the paper by heating the back surface of the web paper WP wound around the heating roller.

The above fixing unit 23 is similar to the drying unit 13 described with reference to FIG. 2. Consequently, the electrophotographic printing apparatus 200 with the fixing unit 23 shown in FIG. 7 can also improve printing efficiency by reducing the time for maintenance of the fixing unit 23.

The above fixing unit 23 corresponds to the "fixing mechanism" in this invention.

<Modifications>

The heat source of the drying unit 13 or fixing unit 23 has been described to be a halogen lamp, but the heat source may be a sheathed heater or electromagnetic inductor.

The rotary cylinder 131 has been described as rotatable by the rotary cylinder drive motor 136. However, the rotary cylinder drive motor 136 may be omitted, and the rotary cylinder 131 may be driven to rotate with transportation of the web paper WP.

The bearings 134, which have been described to be ball bearings, may instead be roller bearings or plain bearings.

Instead of forming the cooling air blowout holes 133H to be arranged perpendicular to the extending direction of the halogen lamp holding member 133 as described hereinbefore, the blowout holes 133H may be arranged at an angle to the flowing direction of the exhaust streams HS. In this case, it is desirable to form the cooling air blowout holes 133H at an angle not exceeding 45°. Since the air streams AS blow out of such cooling air blowout holes 133H in a direction to accelerate the exhaust streams HS, an effect of cooling the rotary shaft 131*a* is acquired by a flow velocity increase of the exhaust streams HS as well as lowering of the temperature of the exhaust streams HS. This can inhibit temperature rise and overheating of the rotary shaft 131*a*, and can prevent damage to the bearing 134*a*.

The web paper WP has been described as the printing medium in the inkjet printing apparatus 100 or electrophotographic printing apparatus 200. However, the heating device of this invention is applicable also to a sheet-fed printing apparatus.

The foregoing description has been made in connection with the printing apparatus operable in the inkjet mode and electrophotographic mode. However, the heating device of this invention is applicable also to an offset printing machine and gravure printing machine which require drying of printing paper.

The heating device of this invention may also be applied to drying of printing paper in a preprocessing apparatus for treatment with a preprocessing liquid before feeding the printing paper to a printing machine, and to drying of printing paper in a post-processing apparatus for treatment with a post-processing liquid after printing on the printing paper in a printing machine.

This invention may be embodied in other specific forms without departing from the spirit or essential attributes thereof and, accordingly, reference should be made to the appended claims, rather than to the foregoing specification, as indicating the scope of the invention.

What is claimed is:

1. A heating device comprising:

a heating member rotatable about a rotary shaft supported by a bearing, the heating member having an opening formed at an end thereof along a direction of the rotary shaft;

a heating element disposed inside the heating member for heating the heating member;

a tubular heating element support member having a heating element support portion at one end thereof for supporting an end of the heating element, and a tube opening at the other end, the tubular heating element support member being inserted into the heating member through the opening; and a coolant supplier for supplying a coolant from the tube opening for cooling the heating element support portion;

wherein the heating element support member includes coolant blowout holes formed between a portion thereof corresponding to the bearing supporting the rotary shaft and the heating element support portion for blowing the coolant supplied from the coolant supplier out into the rotary shaft.

2. The heating device according to claim 1, wherein the coolant supplier comprises a fan for supplying air as the coolant.

3. The heating device according to claim 2, wherein the coolant blowout holes comprise a plurality of perforations formed in the heating element support member.

4. The heating device according to claim 2, which is for use in a drying mechanism for drying ink dispensed to printing paper in an inkjet printing apparatus.

5. The heating device according to claim 2, which is for use in a fixing mechanism for fixing toner adhering to printing paper in an electrophotographic apparatus.

6. The heating device according to claim 1, wherein the coolant blowout holes comprise a plurality of perforations formed in the heating element support member.

7. The heating device according to claim 1, which is for use in a drying mechanism for drying ink dispensed to printing paper in an inkjet printing apparatus.

8. The heating device according to claim 1, which is for use in a fixing mechanism for fixing toner adhering to printing paper in an electrophotographic apparatus.

9. A heating device comprising:

a heating member rotatable about a rotary shaft supported by a first bearing and a second bearing, the heating member having a first opening and a second opening formed at opposite ends thereof, respectively, along a direction of the rotary shaft;

a heat generating member including a heating element, a first tubular heating element support member having a first heating element support portion at one end thereof for supporting one end of the heating element, and a first tube opening at the other end, a second tubular heating element support member having a second heating element support portion at one end thereof for supporting the other end of the heating element, and a second tube opening at the other end, the heat generating member being inserted into the heating member through the first opening and the second opening; and a coolant supplier for supplying a coolant from the first tube opening for cooling the first heating element support portion, and supplying the coolant from the second tube opening for cooling the second heating element support portion;

wherein the heat generating member includes first coolant blowout holes formed between a portion thereof corresponding to the first bearing supporting the rotary shaft and the first heating element support portion for blowing the coolant supplied from the coolant supplier out into the rotary shaft, and second coolant blowout holes formed between a portion thereof corresponding to the second bearing supporting the rotary shaft and the second heating element support portion for blowing the coolant supplied from the coolant supplier out into the rotary shaft.

10. The heating device according to claim 9, wherein the coolant supplier includes a first coolant supplier for cooling the first heating element support portion and a second coolant supplier for cooling the second heating element support portion.

11. The heating device according to claim 10, wherein the coolant supplier comprises a fan for supplying air as the coolant.

12. The heating device according to claim 11, wherein the coolant blowout holes comprise a plurality of perforations formed in the heating element support members.

13. The heating device according to claim 10, wherein the coolant blowout holes comprise a plurality of perforations formed in the heating element support members.

14. The heating device according to claim 10, which is for use in a drying mechanism for drying ink dispensed to printing paper in an inkjet printing apparatus.

15. The heating device according to claim 10, which is for use in a fixing mechanism for fixing toner adhering to printing paper in an electrophotographic apparatus.

16. The heating device according to claim 9, wherein the coolant supplier comprises a fan for supplying air as the coolant.

17. The heating device according to claim 16, wherein the coolant blowout holes comprise a plurality of perforations formed in the heating element support member.

18. The heating device according to claim 9, wherein the coolant blowout holes comprise a plurality of perforations formed in the heating element support members.

19. The heating device according to claim 9, which is for use in a drying mechanism for drying ink dispensed to printing paper in an inkjet printing apparatus.

20. The heating device according to claim 9, which is for use in a fixing mechanism for fixing toner adhering to printing paper in an electrophotographic apparatus.

* * * * *